US005652018A

United States Patent [19]

Tsai

[11] Patent Number: 5,652,018

[45] Date of Patent: Jul. 29, 1997

[54] ARTIFICIAL PEARL FABRICATION METHOD

[76] Inventor: Ting-Chun Tsai, No. 45-289, Tze-Wei Rd., Sanhsia Town, Taipei County, Taiwan

[21] Appl. No.: 761,893

[22] Filed: Dec. 9, 1996

[51] Int. Cl.[6] ..... B05D 7/00

[52] U.S. Cl. ..... 427/219; 427/221; 427/222; 427/387; 427/389.7; 427/430.1; 427/443.2

[58] Field of Search ..... 427/219, 221, 427/222, 387, 389.7, 397.5, 397, 5, 397.7, 430.1, 443.2

*Primary Examiner*—Bernard Pianalto

*Attorney, Agent, or Firm*—Morton J. Rosenberg; David I. Klein

[57] ABSTRACT

A method of fabricating artificial pearls by repeatedly dipping glass or plastic ball elements in a dye liquor and then heat-drying the dip-dyed ball elements at 50°–60° C. for about 15–20 minutes. The dye liquor contains 59 wt %–66 wt % ethyl solvent, 12 wt % acetone, 16.5 wt % cellulose acetate butyrate, 4.4 wt % pearl pigment, 0.55 wt % dye of desired base color, and 0.55 wt % essence.

3 Claims, 2 Drawing Sheets

ARTIFICIAL PEARL FABRICATION METHOD

BACKGROUND OF THE INVENTION

The present invention relates to an artificial pearl fabrication method for fabricating artificial pearls that emit good smell when heated by body heat.

Before going to the outside, every woman usually will use beauty products to make the skin, hair and face beautiful, and perfume to spray over the skin for emitting a pleasant smell. Because perfume is volatile, the pleasant smell of perfume cannot last for long. Therefore, a woman may have to spray perfume daily or several times a day.

SUMMARY OF THE INVENTION

It is one object of the present invention to provide an artificial pearls which emit a pleasant smell when heated by body heat. It is another object of the present invention to provide an artificial pearl fabrication method which is practical for making artificial pearls, that emit a pleasant smell when heated by body heat. According to the present invention, artificial pearls are made from glass or plastic, and then dip-dyeing in a dye liquor, which contains 59 wt %–66 wt % ethyl solvent, 12 wt % acetone, 16.5 wt % cellulose acetate butyrate, 4.4 wt % pearl pigment, 0.55 wt % dye of desired base color, and 0.55 wt % essence. After dip-dyeing, the ball elements are heat dried. The dip-dyeing and heat-drying process may be repeated, until a pearl-like fragrance-emitting coating of desired thickness is formed on each ball element.

DETAILED DESCRIPTION OF THE PREFERRED EMBODIMENT

Figure 1:
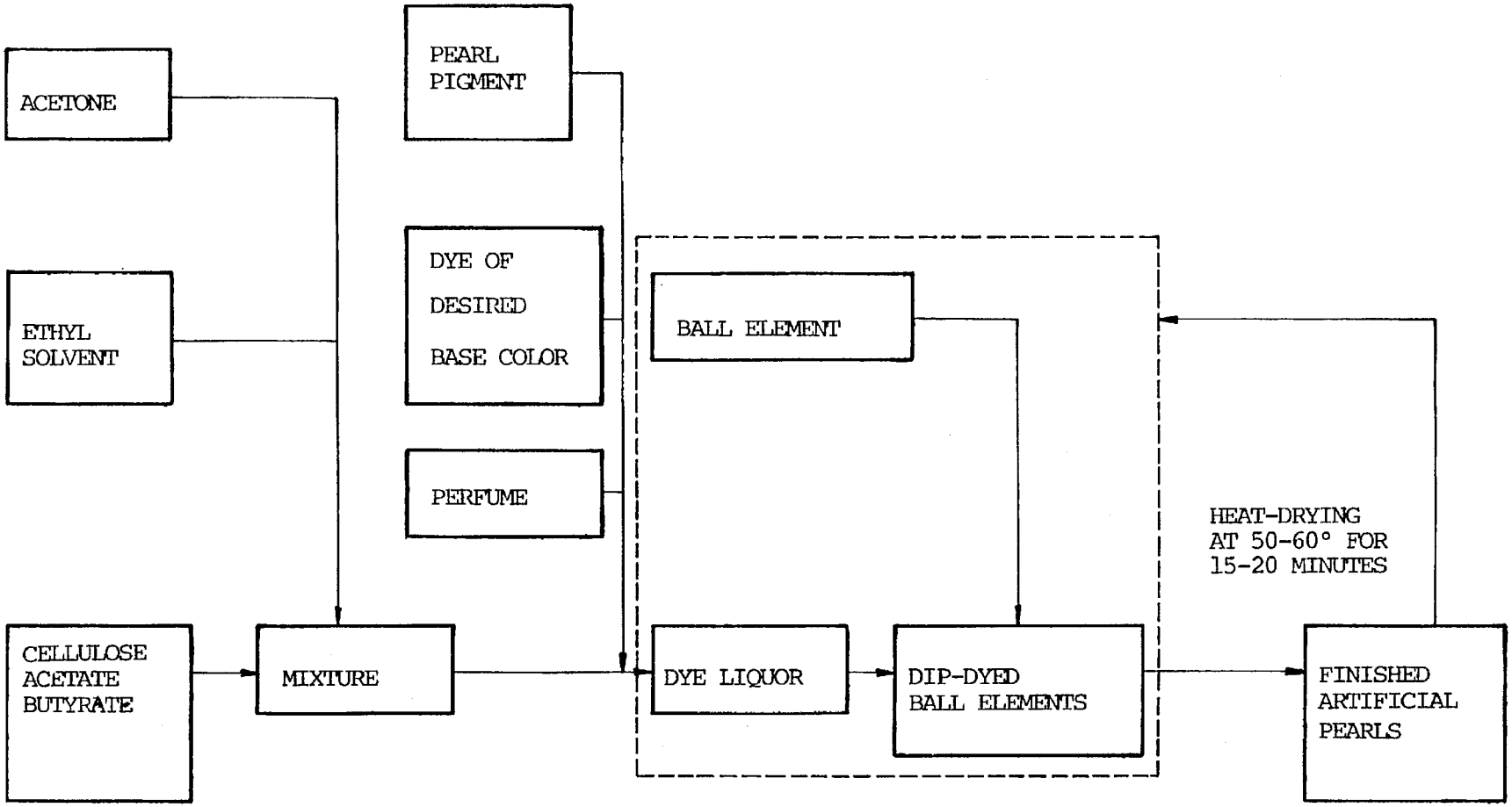
FIG. 1 is a block diagram explaining the artificial pearl production flow according to the present invention.

Referring to FIG. 1, an artificial pearl fabrication method in accordance with the present invention, includes the steps of:

1. mixing 59 wt %–66 wt % ethyl solvent with 12 wt % acetone and 16.5 wt % cellulose acetate butyrate into a mixture;
2. adding 4.4 wt % pearl pigment, 0.55 wt % dye of desired base color and 0.55 wt % essence to the mixture thus obtained, and mixing them well, so as to obtain a dye liquor;

3. dipping ball elements, which are made from glass, plastic, or any material suitable for dip dyeing, in the dye liquor thus obtained for dyeing, and then picking up the ball elements from the dye liquor;
4. heat-drying the initially dip-dyed ball elements at 50°–60° C. for about 15–20 minutes, so that a layer of pearl-like, fragrant coating of certain thickness and particular color is formed over the periphery of each ball element; and
5. repeating steps (3) and (4) until the pearl-like fragrant coating of each ball element has reached the desired level.

Figure 2:
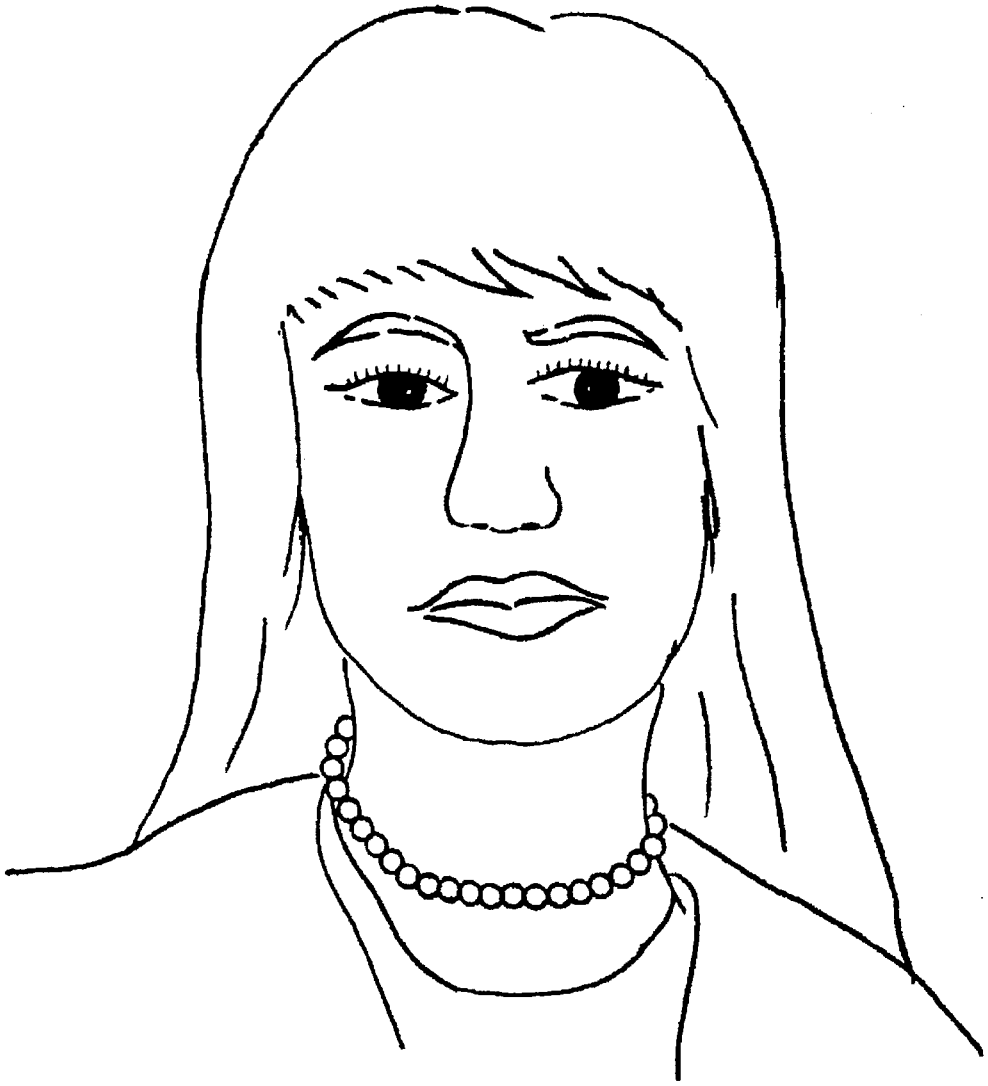
FIG. 2 shows an artificial pearl necklace worn round the neck according to the present invention.

When an artificial pearl necklace made according to the aforesaid procedure is worn around the neck as shown in FIG. 2, it is heated by body heat to emit a pleasant smell.

In the aforesaid procedure, the step (5) can be repeated again and again as desired. Basically, the thinner the coating, the longer the effectiveness of the fragrance emitting power of the artificial pearls. The fragrance emitting power of the artificial pearls can last as long as one year. Furthermore, the length of the heat-drying time can be adjusted subject to the material of the ball elements used. Several materials including glass, plastic, metal, etc., may be used for making ball elements, however wooden material is not suitable for the present invention.

What the invention claimed is:

1. An artificial pearl fabrication method including the steps of:

i) mixing 59 wt %–66 wt % ethyl solvent with 12 wt % acetone and 16.5 wt % cellulose acetate butyrate into a mixture;

ii) adding 4.4 wt % pearl pigment, 0.55 wt % dye and 0.55 wt % essence to the mixture thus obtained, and mixing them well, so as to obtain a dye liquor;

iii) dipping ball elements in the dye liquor thus obtained for dyeing, and then picking up the ball elements from the dye liquor;

iv) heat-drying the initially dip-dyed ball elements at 50°–60° C. for about 15–20 minutes, so that a layer of pearl-like, fragrant coating of certain thickness and particular color is formed over the periphery of each ball element; and v) repeating steps (3) and (4) until the pearl-like fragrant coating of each ball element has reached the desired level.

2. The artificial pearl fabrication method of claim 1 wherein said ball elements are made from glass.

3. The artificial pearl fabrication method of claim 1 wherein said ball elements are made from plastic.

* * * * *